US006042663A

United States Patent [19]

Evans et al.

[11] Patent Number: 6,042,663

[45] Date of Patent: Mar. 28, 2000

[54] PROPELLANT COMPOSITIONS WITH NITROCELLULOSE AND A POLYMER

[75] Inventors: Geoffrey Ian Evans, Malvern; Denis Facer; Michael J. Ruston, both of Kidderminster, all of United Kingdom

[73] Assignee: Royal Ordnance plc, Lancashire, United Kingdom

[21] Appl. No.: 05/775,460

[22] Filed: Mar. 1, 1977

[30] Foreign Application Priority Data

Mar. 3, 1976 [GB] United Kingdom ..... 8536

[51] Int. Cl.[7] ..... C06B 45/10; C06B 25/20

[52] U.S. Cl. ..... 149/19.4; 149/19.8; 149/19.91; 149/100

[58] Field of Search ..... 149/100, 19.91, 149/19.4, 19.8

[56] References Cited

U.S. PATENT DOCUMENTS

| | | | |
|---|---|---|---|
| 3,554,820 | 1/1971 | Evans | 149/100 X |
| 3,711,344 | 1/1973 | Pierce | 149/100 X |
| 3,726,729 | 4/1973 | Pierce | 149/100 X |
| 3,732,130 | 5/1973 | Flanagan et al. | 149/100 X |

*Primary Examiner*—Peter A. Nelson
*Attorney, Agent, or Firm*—Pillsbury Madison & Sutro LLP

[57] ABSTRACT

A rubbery polymer is produced in situ in a cast double base propellant composition.

26 Claims, No Drawings

PROPELLANT COMPOSITIONS WITH NITROCELLULOSE AND A POLYMER

BACKGROUND OF THE INVENTION

The present invention relates to multiple base compositions, for example for use as solid fuel rocket propellants. The compositions are particularly suitable for case-bonded rocket motors.

The term "multiple base composition" used herein refers to compositions employing plasticised nitrocellulose as a matrix. The matrix may carry additional ingredients such as fuels (eg metal particles), oxidisers (eg perchlorates, or nitramine), ballistic modifiers and burning rate stabilisers; this list is not exclusive, since other special additives are also known in the propellant art. The most common form of multiple base composition is the double base type, but triple base compositions are also found.

Double base compositions for use as propellants comprise nitrocellulose and an energetic plasticiser. The latter is usually a nitric ester, and nitroglycerine is most commonly used. Such compositions can be made "smokeless" more easily than "composite propellants" in which oxidisers are incorporated in an elastomeric binder.

In a case-bonded rocket motor, the propellant is bonded to the wall of the motor. This arrangement can provide optimum use of the space within the motor. Similar arrangements may be used in other gas generators using propellant compositions, eg engine starter power cylinders.

Problems are sometimes encountered when case-bonded, double base compositions are exposed to very low storage temperatures. Such compositions commonly have low strain capability at such temperatures, and they may be subjected to stress because of differential expansion and contraction of the casings and propellant composition.

SUMMARY OF THE INVENTION

This invention provides a multiple base composition comprising, in addition to the multiple base components, a polymer which imparts rubbery properties to the composition. The invention further provides a method of making such a composition comprising the step of forming such a polymer therein. The invention further provides a solid fuel charge for a rocket motor, or other gas generator, employing a composition as defined above.

The rubbery properties imparted to the composition are preferably retained at low temperatures, for example as low as −50° C. Additionally, the composition should retain an adequate modulus at higher storage temperatures, eg 60° C., to ensure that it is substantially self-supporting at these temperatures.

The polymer is preferably formed simultaneously with the composition. To facilitate this, a polymer forming component may be mixed with a multiple base component before formation of the composition.

One method of forming a multiple base composition is to cast it, for example by causing a casting liquid (comprising an energetic plasticiser) to flow into a mould containing a casting powder (comprising nitrocellulose and desired solid ingredients). The energetic plasticiser is commonly desensitized by mixing an inert plasticiser with it eg nitroglycerine may be desensitised by addition of triacetin or dimethylphthalate.

A polymer forming component ray be used to desensitise a casting liquid for production of a composition. The preferred casting method is the "base grain" process, in which the casting powder is in the form of premixed pellets, each containing desired proportions of ingredients for the final composition. The polymer forming component may then at least partially replace conventional desensitiser(s). The invention also provides a method of forming a multiple base composition by casting, in which the casting liquid comprises a plasticiser at least partially desensitised by a polymer forming component as described above.

The casting process is preferably of the base grain type. The base grains can be formed by conventional processes but can include a lower proportion of nitrocellulose than those currently used eg the ratio of nitrocellulose to nitroglycerine in the base grain may be around 1:2 by weight, as opposed to the current ratio of 2:1.

Reaction of the polymer forming components is preferably arranged to occur as far as possible during curing rather than during the casting process, since the polymer may interfere with gellation of the nitrocellulose by the plasticiser. Curing is normally effected at a higher temperature than casting, and the polymer forming reaction therefore preferably temperature sensitive, being facilitated at curing rather than casting temperature. Polymerisation may be slow relative to gellation.

The requirements for a polymer system for use in casting can be stated as follows:

(a) polymer and polymer-forming components chemically compatible with energetic plasticiser, (b) at least one polymer-forming component miscible with energetic plasticiser, (c) polymer-forming components polymerisable in highly plasticised environment, (d) rubbery properties of polymer in highly plasticised environment must be an improvement on those of a normal nitrocellulose gel, preferably by retention of these properties to low temperatures, and (e) polymerisation reaction should have little or no exotherm.

The de-sensitised plasticiser is preferably usable in generally known casting techniques, and then there is a further requirement, namely:

(f) viscosity of casting liquid (plasticiser+desensitiser) such as to facilitate conventional casting (preferably less than 100 centipoises at 20° C.).

The invention may enable the use of a higher proportion than normal of energetic ingredients in the composition. This may be achieved in at least two ways, namely 1. the improved mechanical properties of the matrix material may enable it to carry a greater loading of solid energetic material, such as metal fuels and oxidisers, and
2. the effect of the polymer may enable an increase in the ratio of energetic plasticiser to nitrocellulose in the matrix.

A composition according to the invention may have a matrix with a nitrocellulose content of 40% (by weight) or less. Preferably the nitrocellulose content in the matrix is under 30% and matrix nitrocellulose contents around 20% have proved satisfactory.

In one method and composition according to the invention, the polymer is formed by a reaction involving a polyisocyanate. Preferably, the reaction involves a polyol to produce a polyurethane elastomer. The preferred polyols are polyester polyols, particularly, but not exclusively, polycaprolactones. Polyethylene-butylene adipate is an alternative to polycaprolactone.

Polyester polyols can be added to an energetic plasticiser to desensitize it, and the desensitized plasticiser can then be stored for extensive periods prior to use in forming the composition.

The molecular weight of the polyol should be as high as possible subject to its solubility in the nitroglycerine. Polycaprolactones of molecular weight in the range 600–1250 may be used. For polyester polyols other than polycaprolactones, molecular weights in the range 1000–3000, and preferably 1000–2000, may be used.

The reaction should produce urethane linkages and may form both urethane and allophenate linkages.

Preferably both aliphatic and aromatic isocyanates are used. The preferred aliphatic isocyanate is trimethyl hexamethylene diisocyanate, but isophorone diisocyanate (a cycloaliphatic compound) is a possible alternative. The preferred aromatic isocyanate is diphenylmethane-4, 4'-diisocyanate, and/or isomers thereof; toluene and xylene diisocyanates, and/or isomers thereof, are possible alternatives. There may be a mixture of aliphatic and aromatic isocyanates in the proportions 1:1 by weight. Preferably the isocyanate(s) have a slower reaction rate with water than with the selected polyol(s).

One or more catalysts may be employed to facilitate the required reaction. Suitable catalysts are di-butyl tin diacetate and ferric acetylacetonate, but alternative catalysts may be used. Preferably any catalyst employed facilitates urethane and allophanate reactions in preference to reactions between isocyanate(s) and water.

There may be a slight excess of isocyanate over that required for stoichiometric combination to form the additional polymer. The required excess depends upon the hydroxyl functionality of the nitrocellulose, which inevitably takes up some of the isocyanate. The required excess can be determined empirically; for the above compounds, an excess in the region 5–10% by weight of the isocyanate has been found suitable.

The isocyanate component could be added to the plasticiser as a desensitizer, but preferably this arrangement is not used because isocyanates tend to be volatile, and they will also tend to react with water to produce carbon dioxide which may also produce storage problems. Generally the polyol is used as a desensitizer and the isocyanate added just prior to casting.

Proportions (by weight) for a suitable casting liquid are as follows:

Nitroglycerine—60 to 89.8 parts, and preferably 70–80 parts

Polyol—5 to 32 parts, and preferably 7–22 parts

Isocyanate—up to 9 parts.

The amount of isocyanate required will depend upon the amount which reacts in use with the nitrocellulose, and the molecular weight of the reactants. The preferred reactants are diols and diisocyanates.

In any composition according to the invention, the additional polymer is preferably an elastomer having a glass transition temperature below −25° C.

In an alternative method and composition according to the invention, the polymer is based on a vinyl compound, preferably an acrylate. Preferred acrylates are derived from aliphatic alcohols, preferably alkanols. Alkyl acrylates having between two and eight carbon atoms in the alkyl group will form rubbers when polymerised. However, the glass transition temperature of the rubber increases as the number of carbon atoms in the alkyl group falls, giving poorer low temperature properties. Also miscibility with energetic plasticiser of a casting liquid falls as the number of carbon atoms in the alkyl group increases. Further alkyl acrylates between butyl acrylate and octyl acrylate are not readily available. The preferred alkyl acrylate is therefore butyl acrylate, in its normal form or in an isomeric form. However, at least a proportion of ethyl hexyl acrylate, preferably 2-ethyl hexyl acrylate, may be used.

Butyl acrylate can be mixed with plasticiser such as nitroglycerine and the liquid can be stored. A free radical polymerisation initiator can be added immediately before use: such initiators include azo compounds especially azo bis-isobutyronitrite and peroxides especially lauryl peroxide. Preferably the initiator does not produce free radicals at temperatures substantially below the casting and/or cure temperature of the multiple base composition—say below 30° C. For this purpose, tertiary butyl cyclohexyl perdicarbonate is preferred.

In a further method in accordance with the invention, a mixture of a polyol and a hydroxy acrylate is reacted with an isocyanate to produce a mixed polymer including both the polyol and the acrylate. Simultaneously, a suitable catalyst can be included to cause polymerisation of the acrylate.

In yet a further method, a polyol pre-polymer is end capped with an isocyanate. In formation of the composition, the isocyanate end capping can be reacted with a polyol (diol or triol). The end capped pre-polymer can be added to the energetic plasticiser as a desensitizing agent. A suitable pre-polymer can be formed from the polyols discussed above, and a typical polyol for reaction therewith is 1,4 butane diol.

The proportion of rubbery polymer (elastomer) required in the composition will depend upon the elastomer, the service conditions for which composition is designed, and upon the other ingredients of the composition. Less than 2% by weight of any elastomer is unlikely to significantly improve low temperature properties. In compositions having low nitrocellulose contents, say below 25% by weight, elastomer contents of less than 3% by weight tend to give inadequate modulus at storage temperatures around 60° C. On the other hand, continued addition of elastomer may interfere with gellation of the nitrocellulose by the plasticiser and/or be achieved only by substitution for more energetic ingredients.

DESCRIPTION OF THE PREFERRED EMBODIMENTS

By way of example, some specific compositions in their use as solid fuel rocket propellants in accordance with the invention will now be described in greater detail. Since existing propellant base grain casting techniques are used in each case, a brief description of such techniques will be given first and will be understood to apply to each example.

In these casting techniques, "base grains" comprising nitrocellulose, nitroglycerine and additives are produced to a carefully controlled formulation uniform throughout each grain. The additives may comprise each or any of fuel (for example metal particles), ballistic modifiers, burning rate stabilisers, oxidisers (for example perchlorates or nitramine); this list is not intended to be exclusive, since an advantage of the base grain casting system is that it offers possibilities for a wide range of formulations.

The base grains so formed are small relative to a rocket motor propellant charge, typical grains being 1 mm right cylinders. An appropriate number of them are located in a mould, and a casting liquid, the main ingredient of which is nitroglycerine as energetic plasticiser, is forced into the mould under carefully controlled conditions. The casting liquid is absorbed by the nitrocellulose to form a gel; the base grains swell, and are moulded into a unitary propellant grain which is cured at an elevated temperature over an extended period—frequently several days.

Examples of this process are described in our British Patent No 1 179 415, but the present invention is not limited to the techniques disclosed in that patent. Further, the following examples are used in case bonded rocket motors in which the propellant is cast in place in a propellant chamber which has been lined with a suitable adhesive. Examples of such adhesives are described in our U.S. Pat. No. 3,999,382. Again, however, the invention is not limited to casting in situ or to the particular adhesives of the U.S. patent.

The nitroglycerine is desensitised, by addition of compounds miscible with it, or preferably soluble in it, before use as casting liquid. The problem of miscibility/solubility severely limits the range of possible desensitisers; those conventionally used are triacetin and dimethylphthalate. These conventional desensitisers reduce the net energy obtainable from the composition by displacing more energetic ingredients.

In the following examples, conventional desensitizers are at least partially replaced by compounds which have an additional useful function, namely the production of rubbery properties. The Tables in the various examples give the proportions by weight or the various components in the base grain, casting liquid and propellant grain for the respective example.

EXAMPLE 1

Polycaprolactone and Diisocyanates

TABLE 1

| Component | % Base Grain | % Casting Liquid | % Propellant |
|---|---|---|---|
| Nitrocellulose | 30.0 | | 21.0 |
| Nitroglycerine | 63.0 | 75.0 | 66.6 |
| Stabilisers | 1.0 | 1.0 | 1.0 |
| Ballistic Modifiers | 6.0 | | 4.2 |
| Polycaprolactone | | 17.8 | 5.3 |
| 2,2,4-Trimethyl hexamethylene diisocyanate ) | | 3.1 | 0.95 |
| Diphenylmethane-4,4'-diisocyanate ) | | 3.1 | 0.95 |
| Di Butyl Tin Diacetate | | +0.125 | +0.03 |
| Elastomer | | | 7.2 |

The polycaprolactone is added to the nitroglycerine to desensitize it for storage, transport and handling. The isocyanates and catalyst are added to the desensitized nitroglycerine immediately before it is fed to the mould. There is no substantial exotherm, and the body of composition can be maintained at ambient temperature for one day and at 65° C. for 6 days for curing and completion of polymerisation.

Under standard conditions of uniaxial tensile test, described further below, a conventional propellant produced by a base grain casting technique has a strain capability at −40° C. of 1–2% elongation before failure. Under similar conditions, the above propellant has an elongation of 30–35%. Modulus at higher storage temperature (say 60° C.) is lower than the conventional propellant, but it is acceptable.

EXAMPLE 2

Acrylates

TABLE 2

| Component | % Base Grain | % Casting Liquid | % Propellant |
|---|---|---|---|
| Nitrocellulose | 30.0 | | 21.0 |
| Nitroglycerine | 63.0 | 75.0 | 66.6 |
| Stabiliser | 1.0 | 1.0 | 1.0 |
| Ballistic Modifiers | 6.0 | | 4.2 |
| N-Butyl acrylate | | (monomer) 24.0 | (polymer) 7.2 |
| Free radical initiator | | +0.25 | +0.06 |

The monomer is added to the nitroglycerine to desensitize it for storage, and the initiator is added just before feeding to the mould. Under the same test conditions, the propellant grain had an elongation of 25%.

EXAMPLE 3

Polyethylene Butyleneadipite and Diisocyanates

| Component | % Base Grain | % Casting Liquid | % Propellant |
|---|---|---|---|
| Nitrocellulose | 30.0 | | 21.0 |
| Nitroglycerine | 63.0 | 75.0 | 66.6 |
| Stabilisers | 1.0 | 1.0 | 1.0 |
| Ballistic Modifiers | 6.0 | | 4.2 |
| Polyol (see above) | | 21.4 | 6.0 |
| 2,2,4-Trimethyl Hexamethylene Diisocyanate ) | | 1.29 | 0.6 |
| Diphenyl Methane -4-4' diisocyanate ) | | 1.29 | 0.6 |
| Dibutyl tin diacetate | | +0.125 | +0.03 |
| Elastomer | | | 7.2 |

Under the same test conditions, this composition gave an elongation of 25–30%.

EXAMPLE 4

Polycapralactone with Inert Plasticiser

| Component | % Base Grain | % Casting Liquid | % Propellant |
|---|---|---|---|
| Nitrocellulose | 30.0 | | 21.0 |
| Nitroglycerine | 63.0 | 75.0 | 66.6 |
| Stabilisers | 1.0 | 1.0 | 1.0 |
| Ballistic Modifiers | 6.0 | | 4.2 |
| Polycapralactone | | 7.2 | 2.1 |
| Polyol 2,2,4-Trimethyl Hexamethylene Diisocyanate ) | | 1.3 | 0.45 |
| Diphenyl methane -4-4' diisocyanate ) | | 1.3 | 0.45 |
| Inert Plasticiser | | 14.2 | 4.20 |
| Dibutyl tin diacetate | | +0.125 | +0.03 |
| Elastomer | | | 3.0 |

Under the same test conditions this composition gave an elongation of 35–40%.

EXAMPLE 5

Polyethylene Butyleneadipite with Inert Plasticiser

| Component | % Base Grain | % Casting Liquid | % Propellant |
|---|---|---|---|
| Nitrocellulose | 30.0 | | 21.0 |
| Nitroglycerine | 63.0 | 75.0 | 66.6 |
| Stabilisers | 1.0 | 1.0 | 1.0 |
| Ballistic Modifiers | 6.0 | | 4.2 |
| Polyol (see above) | | 9.12 | 2.67 |
| 2,2,4-Trimethyl Hexamethylene Diisocyanate | ) | 0.34 | 0.165 |
| Diphenyl methane -4-4' diisocyanate | ) | 0.34 | 0.165 |
| Inert Plasticiser | | 14.2 | 4.2 |
| Dibutyl tin diacetate | | +0.125 | |
| Elastomer | | | 3.0 |

Under the same test conditions this composition gave an elongation of 30–35%.

It will be noted that in Examples 4 and 5, the proportion of additional polymer in the final propellant has been roughly halved in comparison with Examples 1 and 3 respectively. This is because it has been found that polyester polyols are poor plasticisers of nitrocellulose when compared with the conventional inert plasticisers. Reduction of the polymer content of polyester polyurethanes, and partial replacement thereof by a low temperature plasticiser, has been found to provide slightly improved elongation values at −40° C. and improved gelatinisation of the nitrocellulose. The latter feature has given improved properties at higher storage temperatures, say 60° C. Suitable low temperature plasticisers include alkyl adipates, azelates, phthalates, citrates and phosphates, among others. Triacetin was used in the Examples.

Reduction in the proportion of elastomer in the composition does affect the strain rate dependance of the elongation properties of the composition. The low temperature elongation of a composition including 7–8% polyurethane elastomer is substantially strain-rate independent. The low temperature elongation of a composition including only 3% polyurethane elastomer is strain rate dependent to a degree which is acceptable for most practical purposes.

Acrylates have been found to have good plasticising properties, in relation to nitrocellulose. The acrylate elastomers may therefore replace all of the conventional desensitiser in casting liquids eg acrylates may in some cases provide about 25% by weight of the total composition.

In any embodiment, it will not normally be desirable to continue addition of polymer to such a degree that it displaces ingredients providing a substantial part of the energy of the composition. Thus, for a propellant which does not include fuels and oxidisers, as in Examples 1–5, the elastomer should not displace nitroglycerine. However, where other more energetic ingredients are included, eg in the "composite modified" double base propellants, the elastomer may displace some of the nitroglycerine if required.

In further tests, the compositions given in Examples 1 and 4 have been modified by the inclusion of more energetic ingredients, such as a a high explosive, eg RDX, or b a metal fuel and oxidiser, eg aluminium and ammonium perchlorate.

The further tests have shown that elongation at −40° C. is not deleteriously affected by addition of 30 parts of (a) or (b) to each 100 parts of the base grain composition given in Examples 1 and 4, the casting liquid composition being the same. In addition of (b), the fuel and oxidiser are preferably used in substantially equal weight proportions. Similar results could be expected for addition of energetic ingredients to the compositions of Examples 2, 3 and 5.

The elongation tests referred to above involved stretching a "dumbbell" of composition at the specified temperature and at a rate of 50 mm per mm original length per minute. The elongation figure quoted is the elongation at maximum stress. In each of the examples given, the composition displayed elastic elongation—there was no plastic phase.

The invention is not limited to details of the Examples. The polyesters can be derived from adipic acid and one or more alkalene glycols. Suitable glycols are those having two to six carbon atoms, for example ethylene glycol and butylene glycol. As indicated by the examples, good results have been obtained using polyesters derived from a mixture of alkalene glycols, eg a mixture of ethylene glycol and butylene glycol.

Substantially equal proportions of aliphatic and aromatic diisocyanates are preferred, but mixtures comprising 0–40 wt % aliphatic diisocyanates may prove useful.

The alkyl acrylate is conveniently an unsubstituted acrylate, but if desired it can be a substituted acrylate. The substituent(s) should be such that they do not have a deleterious effect on miscibility or other feature of the process. Suitable substituents are, for example, hydroxyl and nitro groups.

The alkyl acrylate polymers are normally homopolymers, but copolymers may also be used.

The preferred casting process is the base grain process described above but the compositions described herein should also produce improved low temperature propellants made by other processes eg slurry casting and extrusion processes. In contrast with other processes, the base grain process involves some degree of pre-mixing of the nitrocellulose with a plasticiser, usually the energetic plasticiser such as nitroglycerine, before combination thereof with the casting liquid. Conventional base grains comprise about 60% by weight of nitrocellulose and 30% by weight of nitroglycerine. It will be noted that this ratio has been substantially reversed in the Examples, giving a softer grain which is more easily penetrated by the casting liquid. A further increase in the ratio of nitroglycerine to nitrocellulose would be desirable, but may introduce safety problems in production of base grains. Conventional base grain process use grain sizes ranging from ¼ mm to 2½ mm right cylinders; the same sizes can be used in the present invention, although grains around 1 mm right cylinders are preferred.

Further, in the conventional base grain process, in which the conventional base grains are combined with a casting liquid using about 18% inert plasticiser in place of the polymer forming components shown in Example 1, the energy of the composition has been measured at about 1100 calories/gm. In contrast, a composition in accordance with Example 1 has given between 1200 and 1300 calories/gm.

There are known elastomer modified double base compositions in which the elastomer is said to be cross linked with the nitrocellulose. In contrast, the elastomers of the quoted examples are believed to be substantially unreacted with the nitrocellulose. For a polyurethane elastomer some reaction of the isocyanate with the nitrocellulose is inevitable, as we have indicated above. However, it is believed that this reaction tends to increase modulus and give lower elongation values; for example, where as substantial excess of isocyanate was provided (about 50% excess over stoichiometric by weight), the elongation of the composition at −40° C. was much lower than those obtained in the above examples. In the preferred embodiments of the present invention, it is believed that most of the isocyanate reacts preferentially with the polyol.

The preferred catalyst for the acrylate reaction is tributyl cyclohexyl perdicarbonate, which was used in Example 2 quoted above. The preferred catalyst for the urethane and/or allophenate reaction is di-butyl tin diacetate (DBTD). Ferric acetyl acetonate can be used in combination with DBTD. Other catalysts giving useful results are dibutyl tin dilaurate, stannous octoate, triphenylbismuth, phenylmercuric acetate and lead 2-ethyl hexanuate.

Suitable components for use in processes according to the above Examples may be obtained as follows Polycaprolatones (i) CAPA 220, 210, 200, 230X, 240X, 420, 304X, 310X and 610X, obtainable from Interox Chemicals Limited, Luton, Bedfordshire, England.

(ii) NIAX D520, D540 and D560, obtainable from Union Carbide.

Ethylene Butylene Adipate

| Trade Name | Supplier |
|---|---|
| Estolan HU 11A | Lankro Chemicals, Eccles, Lancs, England |
| Crestapol 74 | Scott-Bader |
| Diorez 750 | Briggs & Townsend |

Other suitable polyester polyols are those of the Estolan range of Lankro Chemicals and the Crestapol range of Scott-Bader eg di ethylene glycol adipate (Estolan HU3A), monoethylene glycol adipate (Estolan HU5A and Crestapol 70), butane diol adipate (Estolan HU10A and Crestapol 76). Still further suitable polyols are those of the Daltorol range of Imperial Chemical Industries eg ethylene propylene adipate (Daltorol PR3) and polyoxyethylene adipate (Daltorol $PR_1$).

The glass transition temperature of the elastomer should be below the designed service temperature for the composition. The invention is intended particularly but not exclusively to enable use of multiple base compositions at low temperatures. Accordingly, an elastomer with a glass transition temperature below −25° C. is desirable. Preferably the glass transition temperature is below −35° C., and elastomers with glass transition temperatures below −50° C. are highly desirable.

What is claimed is:

1. A process for making a multiple base propellant which comprises bringing together nitrocellulose, an energetic liquid plasticiser for the nitrocellulose and one or more polymerisable components that can be polymerised in situ to produce an elastomer imparting rubbery properties to the composition, and effecting polymerisation of said component(s), the nitrocellulose content of the propellant being less than about 30% by weight.

2. A process according to claim 1 wherein at least part of the or of at least one polymerisable component is present in the plasticiser to desensitize the plasticiser prior to bringing the plasticiser together with the nitrocellulose.

3. A process according to claim 1 wherein the energetic plasticiser comprises nitroglycerine.

4. A process according to claim 1 wherein the nitrocellulose content of the propellant is about 20% by weight.

5. A process according to claim 1 wherein there are used polymerisable components that react together to form a polyurethane elastomer.

6. A process according to claim 5 wherein there are used polymerisable components that react together to form a polyester urethane elastomer.

7. A process according to claim 6 wherein the polymerisable components comprise a polycaprolactone and a polyisocyanate.

8. A process according to claim 6 wherein the polymerisable components comprise a polyester polyol derived from adipic acid and a polyisocyanate.

9. A process according to claim 1 wherein there are used one or more aliphatic acrylates as polymerisable component (s).

10. A process according to claim 9 wherein the or each acrylate is an alkyl acrylate having from 2 to 8 carbon atoms in the alkyl group.

11. A process according to claim 10 wherein the or at least one of said acrylates is a butyl acrylate.

12. A process according to claim 1 wherein the amount of polymerisable component(s) is so selected that the amount of elastomer in the propellant is from 2 to 8% by weight.

13. A base grain casting process for making a multiple base propellant comprising the steps of placing grains comprising nitrocellulose in a mould, pouring into the mould an energetic liquid plasticiser for the nitrocellulose, said plasticiser containing one or more polymerisable components that can be polymerised to form an elastomer, and effecting polymerisation of said component(s), the nitrocellulose content of the composition being less than about 30% by weight.

14. A process according to claim 13 wherein said grains also comprise an energetic plasticiser.

15. A process according to claim 14 wherein the weight ratio of nitrocellulose to energetic plasticiser in the grains is about 1:2.

16. A process according to claim 13 wherein said energetic plasticiser is nitroglycerine.

17. A process according to claim 13 wherein the nitrocellulose content of the composition is about 20% by weight.

18. A process according to claim 13 wherein the energetic plasticiser contains, as polymerisable components, a polycaprolactone and a polyisocyanate.

19. A process according to claim 13 wherein the energetic plasticiser contains, as polymerisable component(s), one or more alkyl acrylates having from 2 to 8 carbon atoms in the alkyl group.

20. A process according to claim 19 wherein there is used a butyl acrylate as a polymerisable component.

21. A process according to claim 13 wherein the amount of polymerisable component(s) is so selected that the amount of elastomer in the propellant is from 2 to 8% by weight.

22. A case-bonded, solid propellant rocket motor wherein the solid propellant comprises a multiple base propellant obtained according to claim 1.

23. A multiple base composition having a matrix comprising (a) nitrocellulose but in an amount of less than about 30% by weight; and (b) a polymer comprising polyurethane or polymerized aliphatic acrylate elastomer which is substantially unreacted with the nitrocellulose.

24. A multiple base composition according to claim 22, wherein said polyurethane comprises a polyester polyurethane elastomer, said polymer imparting rubbery properties to said compositions.

25. A multiple base composition according to claim 24, wherein said polymer comprises polymerized aliphatic acrylate elastomer.

26. A multiple base composition according to claim 23, wherein the polymer has a glass transition temperature, when separate from the composition, below −25° C.

* * * * *